US007802607B2

(12) United States Patent
Crider

(10) Patent No.: US 7,802,607 B2
(45) Date of Patent: Sep. 28, 2010

(54) COMBINATION GARAGE DOOR AND ROLL-UP CURTAIN SYSTEM

(76) Inventor: Grant W. Crider, 2770 County Rd. 71, Bremen, AL (US) 35033

( * ) Notice: Subject to any disclaimer, the term of this patent is extended or adjusted under 35 U.S.C. 154(b) by 0 days.

(21) Appl. No.: 11/880,720

(22) Filed: Jul. 24, 2007

(65) Prior Publication Data

US 2009/0025886 A1 Jan. 29, 2009

(51) Int. Cl.
*A47H 1/00* (2006.01)
*E05D 15/00* (2006.01)

(52) U.S. Cl. ..... 160/89; 160/201

(58) Field of Classification Search ..... 160/113, 160/117, 118, 201, 266, 268.1, 270, 273.1, 160/89
See application file for complete search history.

(56) References Cited

U.S. PATENT DOCUMENTS 1,612,261 A 12/1926 Burns
2,270,978 A 1/1942 Swormstedt
2,325,992 A 8/1943 Wirthman
3,017,927 A 1/1962 Demko
3,116,097 A 12/1963 Novales
3,421,568 A 1/1969 Youngs
3,489,200 A 1/1970 Recchione
4,237,956 A * 12/1980 Sivin et al. ..... 160/120
4,649,981 A 3/1987 Bibeau
4,957,301 A 9/1990 Clay, Jr. et al.
5,131,450 A 7/1992 Lichy
5,351,742 A 10/1994 Lichy
5,482,104 A 1/1996 Lichy
5,533,561 A 7/1996 Forehand, IV
5,566,736 A 10/1996 Crider et al.
5,737,802 A 4/1998 Jella
5,752,557 A 5/1998 Crider et al.
5,785,105 A 7/1998 Crider et al.
5,931,212 A 8/1999 Mullet et al.
5,960,847 A 10/1999 Crider et al.
6,053,235 A * 4/2000 Ruffner, Sr. ..... 160/89
6,098,696 A 8/2000 Styra
6,138,739 A 10/2000 Crider et al.
6,209,614 B1 4/2001 Smoot
6,250,360 B1 * 6/2001 Ochoa ..... 160/201
6,289,963 B1 * 9/2001 Vaske ..... 160/89
6,401,792 B1 6/2002 Mullet et al.

(Continued)

*Primary Examiner*—Katherine W Mitchell
*Assistant Examiner*—Jeremy C Ramsey
(74) *Attorney, Agent, or Firm*—Kenneth M. Bush; Gerald M. Walsh; Bush Intellectual Property Law

(57) ABSTRACT

A combination garage door and roll-up curtain system that allows a flexible curtain to be lowered when the garage door is in a raised position. The system preferably comprises an automated garage door assembly wherein the drive mechanism is mounted to a bracket mounted in turn to the inside wall above the garage opening upper margin. The system preferably further comprises an automated roll-up curtain assembly having a rotatable rod mounted above the garage opening upper margin between the bracket and the inside wall. The rotatable rod has a flexible curtain wound thereabout wherein the first end of the curtain is affixed to the rod and the second end of the curtain is secured along its lateral margins within tracks mounted adjacent the garage opening lateral margins. The second end of the curtain preferably has a weighted member attached thereto to urge the curtain toward the garage opening lower margin and to keep the curtain taut.

19 Claims, 4 Drawing Sheets

U.S. PATENT DOCUMENTS

| | | | | |
|---|---|---|---|---|
| 6,431,250 | B2 | 8/2002 | Mullet et al. | |
| 6,484,447 | B1 | 11/2002 | Snyder et al. | |
| 6,691,761 | B1 | 2/2004 | Alkhoury et al. | |
| 6,705,378 | B1 * | 3/2004 | Smidt | 160/120 |
| 6,851,464 | B2 | 2/2005 | Hudoba et al. | |
| 6,942,001 | B1 | 9/2005 | Crider et al. | |
| 7,128,125 | B2 | 10/2006 | Harbison | |
| 2004/0020607 | A1 * | 2/2004 | Aguirre et al. | 160/113 |
| 2004/0144499 | A1 * | 7/2004 | Pannell | 160/113 |
| 2005/0252619 | A1 * | 11/2005 | Coenraets | 160/89 |
| 2006/0137832 | A1 * | 6/2006 | Alexander | 160/113 |

* cited by examiner

COMBINATION GARAGE DOOR AND ROLL-UP CURTAIN SYSTEM

FIELD OF THE INVENTION

The present invention relates to closures for portals and, more particularly, to closures for garage portals.

BACKGROUND OF THE INVENTION

Garages and garage doors are well known in the prior art. A typical homeowner uses a residential garage to store vehicles, yard tools, etc. A garage door is typically opened to move items into or out of the garage, after which, the garage door is closed. It is sometimes desirable to leave the garage door open to allow light or fresh air into the garage. However, a resulting problem is that insects or animals can get into the garage. Accordingly, what is needed, and is not found in the prior art, is a combination garage door and roll-up curtain system that allows a flexible curtain to be lowered when the garage door is in a raised position.

SUMMARY OF THE INVENTION

The present invention is a combination garage door and roll-up curtain system that allows a flexible curtain to be lowered when the garage door is in a raised position. The system comprises a bracket mounted to the inside wall above the garage opening upper margin. The bracket has a substantially horizontal portion that is secured to the wall and a substantially vertical portion that extends downward from the horizontal portion, wherein the vertical portion is offset from the wall. The system preferably further comprises a typical automated garage door assembly wherein the drive track is mounted to the vertical portion of the bracket rather than directly to the wall as found in current garage door assemblies. The system preferably further comprises an automated roll-up curtain assembly having a rotatable rod mounted above the garage opening upper margin between the vertical portion of the bracket and the inside wall. The rotatable rod has a flexible curtain wound thereabout wherein the first end of the curtain is affixed to the rod and the second end of the curtain is secured along its lateral edges within tracks mounted adjacent the garage opening lateral margins. The second end of the curtain preferably has a weighted member attached thereto to urge the curtain toward the garage opening lower margin and to keep the curtain taut. The system preferably further comprises a master control system operably connected to the garage door assembly and the roll-up curtain assembly.

In operation, the garage door can be raised or lowered as is known in the prior art. When the garage door is lowered, the curtain is preferably in a raised position. When the garage door is raised, the curtain assembly can be activated to unroll the curtain, thereby lowering the curtain. The master control system preferably prevents the curtain from being lowered when the garage door is lowered and preferably prevents the garage door from being lowered when the curtain is lowered.

These and other features of the invention will become apparent from the following detailed description of the preferred embodiments of the invention.

DETAILED DESCRIPTION OF THE PREFERRED EMBODIMENTS

Figure 1:
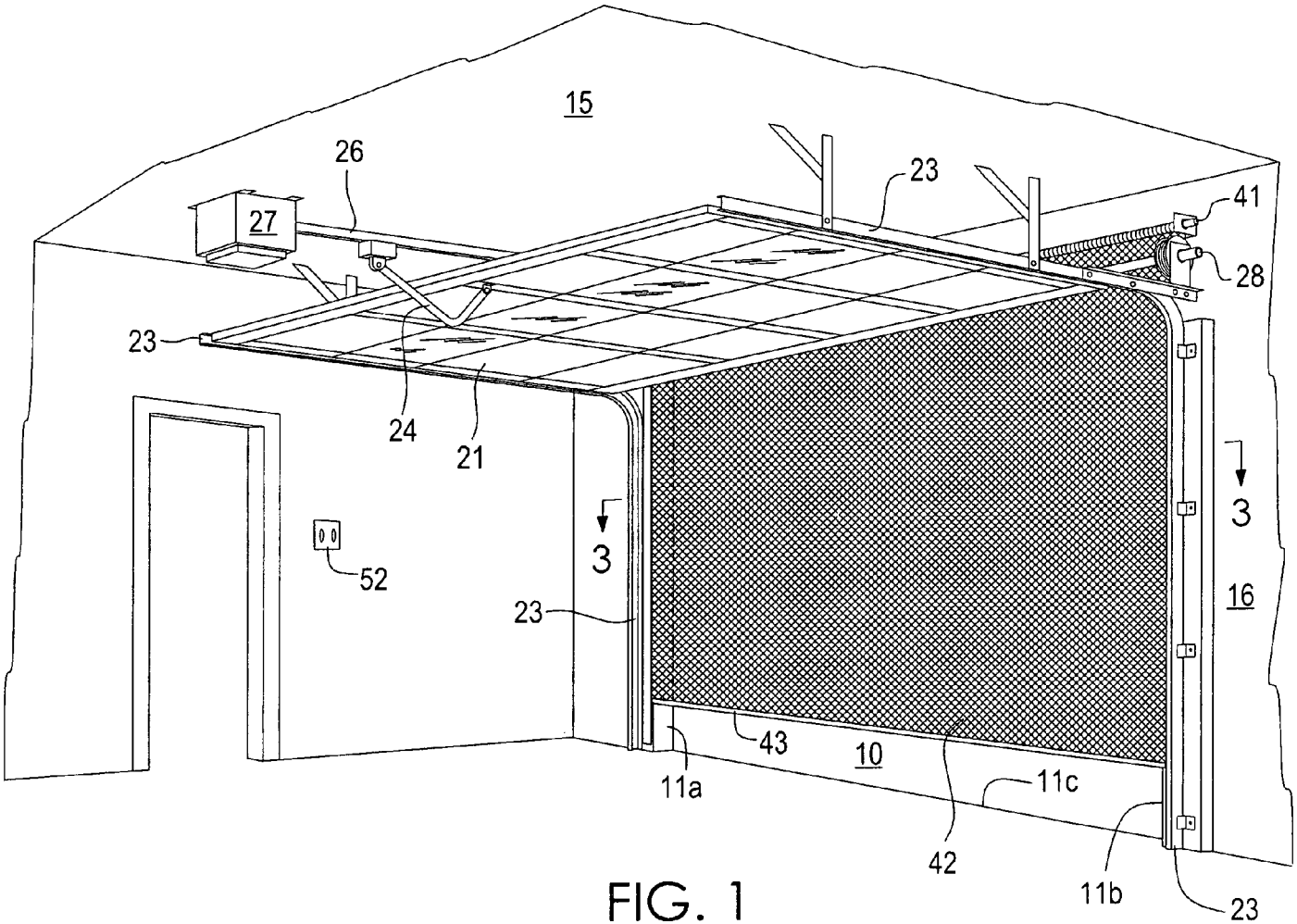
FIG. 1 is a perspective view of the present invention with the garage door in a raised position and the curtain in a lowered position.

The present invention is a combination garage door and roll-up curtain system for selectively covering and uncovering a garage opening 10 defined by upper, lower, and opposing lateral margins. The invention disclosed herein is technology related to U.S. Pat. Nos. 5,566,736, 5,752,557, 5,785,105, 5,960,847, 6,138,739, and 6,942,001, the disclosures of which are incorporated herein by reference.

In the preferred embodiment shown in FIGS. 1-6, the invention comprises a garage door assembly and a roll-up curtain assembly. The garage door assembly is preferably a customary automated garage door assembly comprising a garage door 21 having rollers 22, and tracks 23 secured to the garage roof 15 and inside wall 16 in proximity to the garage opening 10 lateral margins 11*a*, 11*b*. A pivot arm 24 connects the garage door 21 to a linear drive track 26 attached at one end to a drive unit 27 and at an opposite end to a bracket 31 mounted to the wall 16 above the garage opening 10 upper margin. A torsion spring 28 is secured at opposing ends above the garage opening 10 upper margin. The garage door assembly as described above and the operation thereof, except for the bracket 31 and the drive track 26 being attached thereto, are well known in the art.

Figure 2:
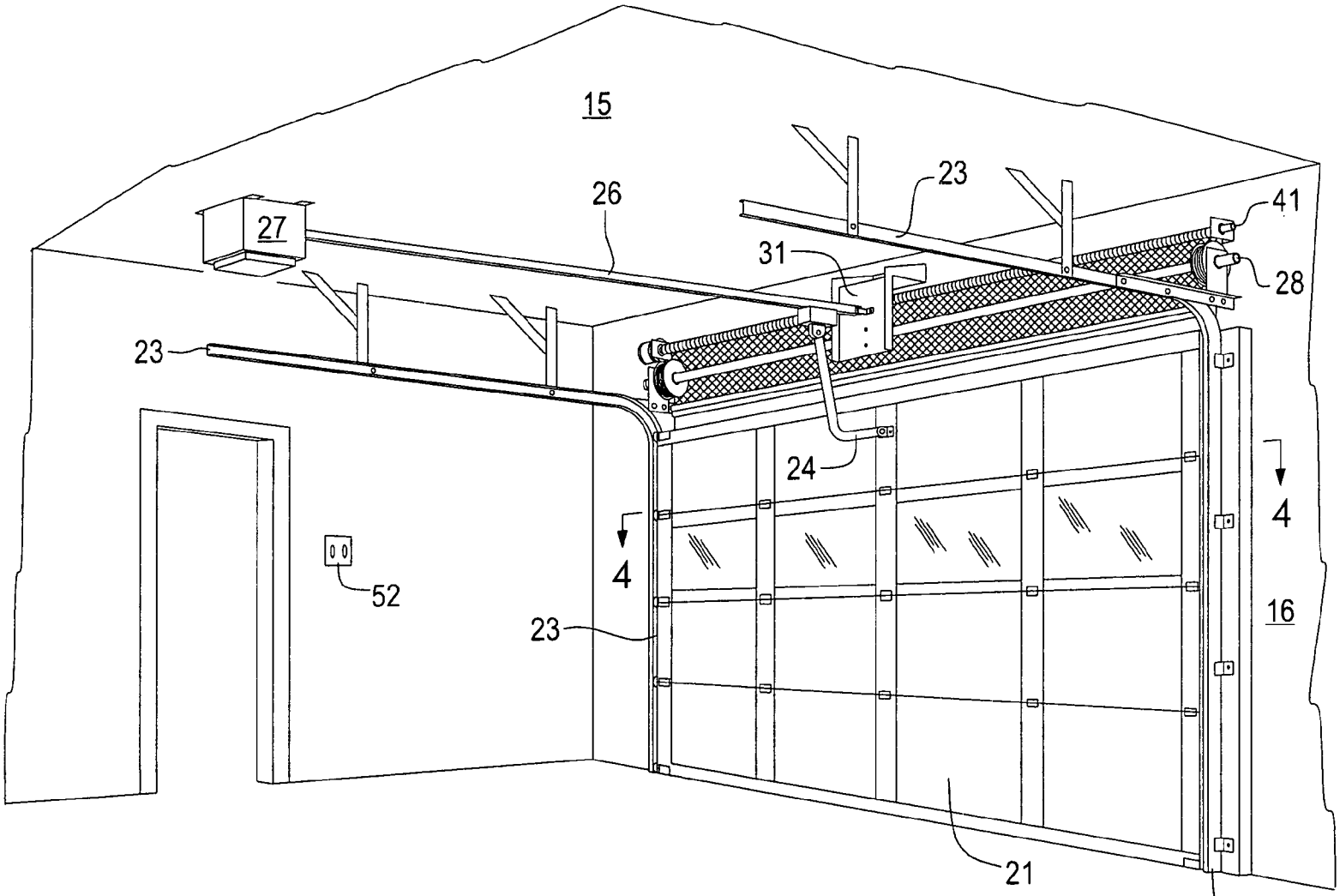
FIG. 2 is a perspective view of the present invention with the garage door in a lowered position and the curtain in a raised position.
Figure 6:
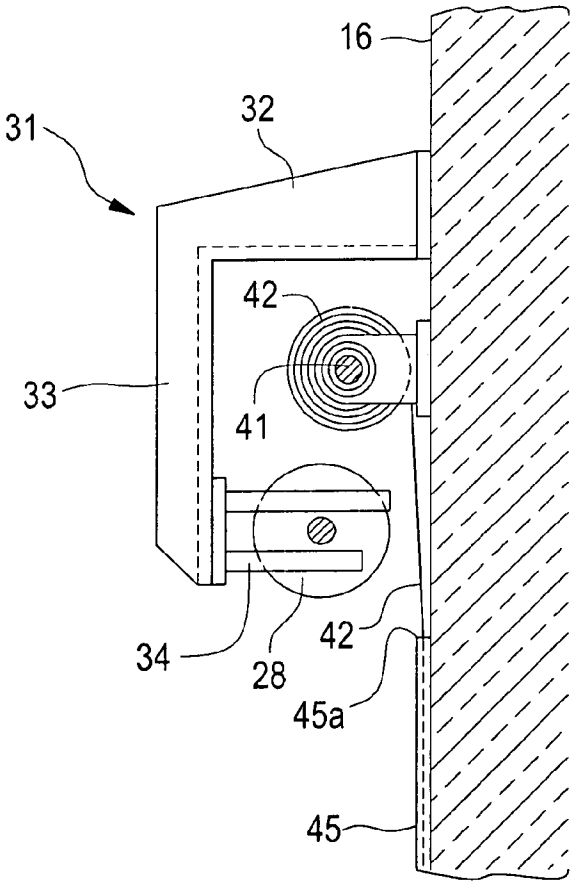
FIG. 6 is a side view, partially in section, of the preferred bracket assembly.

The bracket 31, shown in FIGS. 2 and 6, comprises a substantially horizontal portion 32 that is secured to the wall 16 and a substantially vertical portion 33 that extends downward from the horizontal portion 32, wherein the vertical portion 33 is offset from the wall 16. The drive unit 27 is preferably mounted to the vertical portion 33. In embodiments utilizing a torsion spring 28, the bracket 31 preferably has an extension member 34 for additional support of the torsion spring 28. In prior art garage door assemblies utilizing torsion springs, the extension member for supporting the torsion spring is attached directly to the wall, which would interfere with the roll-up curtain assembly of the present invention.

The invention further comprises a roll-up curtain assembly having a rotatable rod 41, or "drive pipe", mounted above the garage opening 10 upper margin between the vertical portion 33 of the bracket 31 and the wall 16. The rod 41 has a flexible curtain 42 wound thereabout wherein the upper first end of the curtain 42 is affixed to the rod 41 and the lower second end of the curtain 42 is secured along its lateral edges 42*a* within linear tracks 45 mounted adjacent the garage opening 10 lateral margins 11*a*, 11*b*. The second end of the curtain 42 preferably has a weighted member 43 attached thereto to urge the curtain 42 toward the garage opening 10 lower margin 11*c* and to keep the curtain 42 taut.

Figure 4:
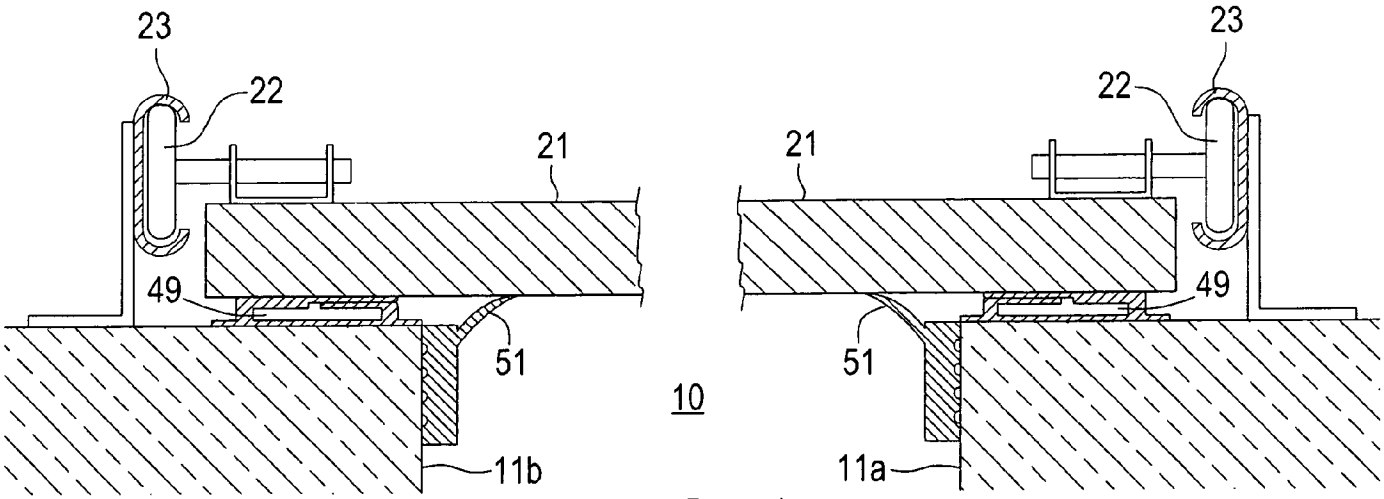
FIG. 4 is a sectional view taken along line 4-4 of FIG. 2.
Figure 5:
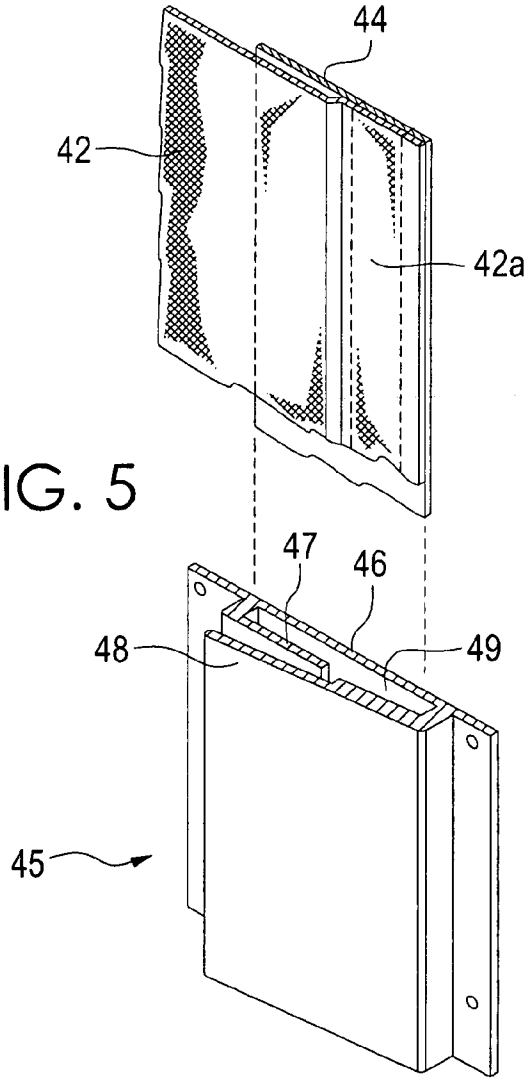
FIG. 5 is an exploded perspective view of the curtain/curtain track assembly.

The curtain 42 preferably comprises a fabric stiffener 44 sewn to the curtain edges 42*a*, best shown in FIG. 5, to prevent the curtain edges 42*a* from being separated from the tracks 45. The curtain 42 is preferably made from a porous screen material that allows transmission of light and air therethrough but blocks transmission of insects or animals. The curtain 42 may include a vertical strip of material (not shown) in the center thereof to counterbalance the added thickness of the sides of the curtain due to the fabric stiffener 44 as the curtain 42 is wrapped about rotatable rod 41. Each curtain track 45, best shown in FIGS. 3-5, preferably comprises a planar back portion 46 that abuts the wall 16, an internal flange 47 having a planar portion in spaced parallel relationship to the back portion 46, and an external flange 48 overlapping the internal flange 47 and having a planar portion in spaced relationship to the back portion 46 and the internal flange 47, thereby forming a longitudinal channel 49 for receiving the curtain edge 42*a* with attached stiffener 44, best shown in FIG. 5. The top edges 45*a* of the curtain tracks 45 are preferably polished or capped to provide smooth surfaces to prevent the curtain 42 from snagging on the top edges as the curtain 42 slides therepast. The curtain tracks 45 are preferably made from an extruded polyvinyl chloride (PVC).

The invention preferably further comprises a vinyl flap 51 mounted to the garage opening 10 lateral margins 11*a*, 11*b* for engaging either the garage door 21 or curtain 42 when in a lowered position. These devices are well known in the art.

The invention can be manually operated; however, the invention preferably comprises a master control system 52 operably connected to a power source and the garage door and roll-up curtain assemblies for operating the invention as described below. The master control system may utilize limit switches, optical sensors, or the like, as is known in the art.

Figure 3:
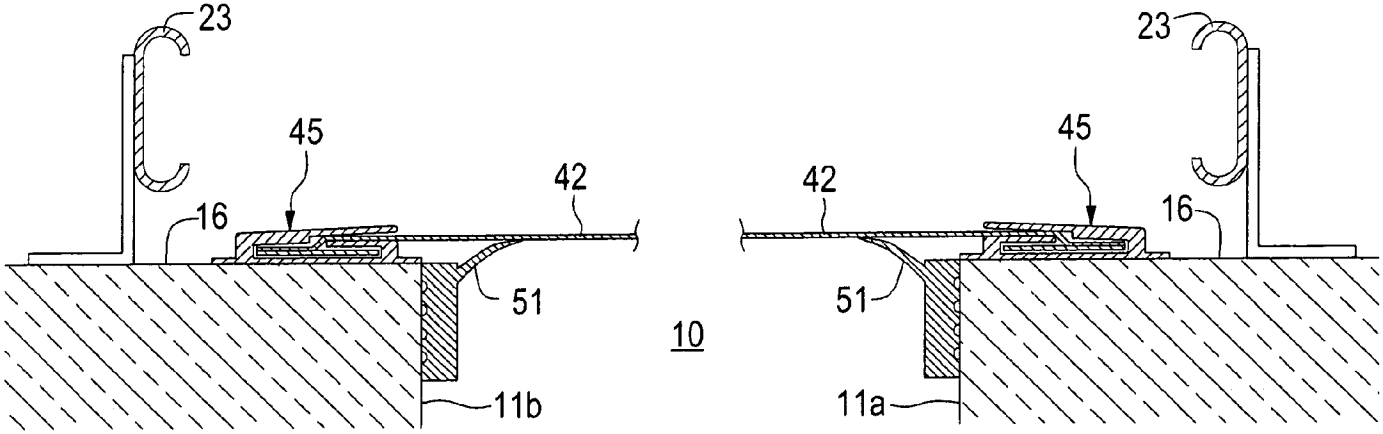
FIG. 3 is a sectional view taken along line 3-3 of FIG. 1.

In operation, the garage door 21 can be raised or lowered as is known in the prior art. When the garage door 21 is lowered as shown in FIGS. 2 and 4, the curtain 42 is preferably in a raised position. When the garage door is raised as shown in FIGS. 1 and 3, the curtain assembly can be activated to unroll the curtain 42 from the rotatable rod 41, thereby lowering the curtain 42. The master control system preferably prevents the curtain from being lowered when the garage door is lowered and preferably prevents the garage door from being lowered when the curtain is lowered. Control systems having these capabilities are well known in the art.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described herein and as recited in the appended claims. For example, the present invention can be used in manually operated garage door or dock door assemblies. Further, the bracket 31 can be configured to accommodate other garage door drive operators as long as the bracket 31 provides a location to mount the roll-up screen assembly. For example, some garage door assemblies include drive units that are mounted directly above the garage opening, such as those taught in U.S. Pat. Nos. 5,931,212 and 6,401,792 assigned to Wayne-Dalton Corporation, the disclosures of which are incorporated herein by reference. In the present invention, these drive units would be attached directly to bracket 31, which could be modified if necessary to support this type of drive unit.

The invention claimed is:

1. A combination garage door and roll-up curtain system for covering and uncovering an opening through a wall, said opening defined by upper, lower, and opposing lateral margins, said system comprising:

a one piece L-shaped bracket mounted to an inside surface of said wall, said bracket including a substantially horizontal portion mounted directly to said inside surface above said upper margin of said opening and extending away from said wall, and a substantially vertical portion extending downward from said horizontal portion, thereby providing an open space between said vertical portion and said wall;

a garage door assembly including a drive unit, a drive track attached at one end to said drive unit and at an opposite end to said vertical portion of said bracket wherein said drive track is supported by said vertical portion and said drive track does not extend beyond said vertical portion of said bracket, a pair of tracks having vertical portions mounted in close proximity to said lateral margins of said opening, a garage door having a plurality of lateral rollers secured within said tracks, and a pivot arm connecting said garage door to said drive track; and a roll-up curtain assembly including a pair of linear tracks mounted to said inside surface of said wall adjacent said lateral margins of said opening, a rotatable rod mounted above said upper margin of said opening between said vertical portion of said bracket and said inside surface of said wall, and a flexible curtain having an upper first end affixed to said rod and a lower second end secured along its lateral edges within said linear tracks;

wherein said rotatable rod is positioned above a torsion spring, said torsion spring operating said garage door and being positioned between said vertical portion of said L-shaped bracket and said inside surface of said wall, said rod being attached to said inside surface of said wall with attachment means which are separate from attachment means used to position said torsion spring between said vertical portion of said bracket and said wall, and wherein said vertical portion of said bracket further comprises an extension member extending horizontally from said vertical portion towards said wall and attaching to and supporting a central portion of said torsion spring thereby providing a space between said torsion spring and said wall thereby allowing said flexible curtain to pass between said torsion spring and said wall.

2. A combination garage door and roll-up curtain system according to claim 1, further comprising a master control system operably connected to a power source, said garage door assembly, and said curtain assembly, wherein said master control system is operable to activate said garage door assembly to lower and raise said garage door and to activate said curtain assembly to lower and raise said curtain.

3. A combination garage door and roll-up curtain system according to claim 2, wherein said master control system is further operable to prevent said curtain from being lowered when said garage door is lowered and to prevent said garage door from being lowered when said curtain is lowered.

4. A combination garage door and roll-up curtain system according to claim 1, further comprising a weighted member attached to said second end of said curtain to urge said second end toward said lower margin of said opening.

5. A combination garage door and roll-up curtain system according to claim 1, further comprising a fabric stiffener attached to each of said lateral edges of said curtain to prevent said lateral edges from being dislodged from said linear tracks.

6. A combination garage door and roll-up curtain system according to claim 1 wherein each linear track comprises a substantially planar back portion that abuts said wall, an internal flange connected to a first side of said back portion and having a substantially planar portion in spaced relationship to said back portion, and an external flange connected to a second side of said back portion and overlapping said planar portion of said internal flange, wherein said external flange has a planar portion in spaced relationship to said back portion and said planar portion of said internal flange, thereby forming a longitudinal channel for receiving one of said lateral edges of said curtain.

7. A combination garage door and roll-up curtain system for covering and uncovering an opening through a wall, said opening defined by upper, lower, and opposing lateral margins, said system comprising:

a one piece L-shaped bracket mounted to an inside surface of said wall, said bracket including a substantially horizontal portion mounted directly to said inside surface above said upper margin of said opening and extending away from said wall, and a substantially vertical portion extending downward from said horizontal portion, thereby providing an open space between said vertical portion and said wall;

an automated garage door assembly including a pair of tracks having vertical portions mounted in close proximity to said lateral margins of said opening, a garage door having a plurality of lateral rollers secured within said tracks, and a drive mechanism secured to and supported by said vertical portion of said bracket such that said drive mechanism does not obstruct a space between said bracket and said wall, wherein said drive mechanism is operably connected to said garage door for raising and lowering said garage door;

an automated roll-up curtain assembly including a pair of linear tracks mounted to said inside surface of said wall adjacent said lateral margins of said opening, a rotatable rod mounted above said upper margin of said opening between said vertical portion of said bracket and said inside surface of said wall, and a flexible curtain having an upper first end affixed to said rod and a lower second end secured along its lateral edges within said linear tracks, wherein each linear track comprises a planar back portion that abuts said wall, an internal flange connected to a first side of said back portion and having a planar portion in spaced relationship to said back portion, and an external flange connected to a second side of said back portion and overlapping said planar portion of said internal flange, wherein said external flange has a planar portion in spaced relationship to said back portion and said planar portion of said internal flange, thereby forming a longitudinal channel for receiving one of said lateral edges of said curtain; and a master control system operably connected to a power source, said garage door assembly, and said curtain assembly, wherein said master control system is operable to activate said garage door assembly to lower and raise said garage door and to activate said curtain assembly to lower and raise said curtain, wherein said master control system is further operable to prevent said curtain from being lowered when said garage door is lowered and to prevent said garage door from being lowered when said curtain is lowered;

wherein said rotatable rod is positioned above a torsion spring, said torsion spring operating said garage door and being positioned between said vertical portion of said L-shaped bracket and said inside surface of said wall, said rod being attached to said inside surface of said wall with attachment means which are separate from attachment means used to position said torsion spring between said vertical portion of said bracket and said wall, and wherein said vertical portion of said bracket further comprises an extension member extending horizontally from said vertical portion towards said wall and attaching to and supporting a central portion of said torsion spring thereby providing a space between said torsion spring and said wall thereby allowing said flexible curtain to pass between said torsion spring and said wall.

8. A combination garage door and roll-up curtain system according to claim 7, further comprising a weighted member attached to said second end of said curtain to urge said second end toward said lower margin of said opening.

9. A combination garage door and roll-up curtain system according to claim 7, further comprising a fabric stiffener attached to each of said lateral edges of said curtain to prevent said lateral edges from being dislodged from said linear tracks.

10. A combination garage door and roll-up curtain system for covering and uncovering an opening through a wall, said opening defined by upper, lower, and opposing lateral margins, said system comprising:

a one piece L-shaped bracket mounted to an inside surface of said wall, said bracket including a substantially horizontal portion mounted directly to said inside surface above said upper margin of said opening and extending away from said wall, and a substantially vertical portion extending downward from said horizontal portion, thereby providing an open space between said vertical portion and said wall;

a garage door assembly including a drive unit, a drive track attached at one end to said drive unit and at an opposite end to said vertical portion of said bracket wherein said drive track is supported by said vertical portion and said drive track does not extend beyond said vertical portion of said bracket, a pair of tracks having vertical portions mounted in close proximity to said lateral margins of said opening, a garage door having a plurality of lateral rollers secured within said tracks, and a pivot arm connecting said garage door to said drive track;

a roll-up curtain assembly including a pair of linear tracks mounted to said inside surface of the wall adjacent said lateral margins of said opening, a rotatable rod mounted above said upper margin of said opening between said vertical portion of said bracket and inside surface of the wall, and a flexible curtain having an upper first end affixed to said rod and a lower second end secured along its lateral edges within said linear tracks; and a weighted member attached to said second end of said curtain to urge said second end toward said lower margin of said opening;

wherein said rotatable rod is positioned above a torsion spring, said torsion spring operating said garage door and being positioned between said vertical portion of said L-shaped bracket and said inside surface of said wall, said rod being attached to said inside surface of said wall with attachment means which are separate from attachment means used to position said torsion spring between said vertical portion of said bracket and said wall, and wherein said vertical portion of said bracket further comprises an extension member extending horizontally from said vertical portion towards said wall and attaching to and supporting a central portion of said torsion spring thereby providing a space between said torsion spring and the wall so that said flexible curtain may pass between said torsion spring and the wall; and wherein each linear curtain track further comprises an internal flange connected to a first side of said back portion and having a substantially planar portion in spaced relationship to said back portion, and an external flange connected to a second side of said back portion and overlapping said planar portion of said internal flange, and wherein said external flange has a substantially planar portion in spaced relationship to said back portion and to said planar portion of said internal flange thereby forming a longitudinal channel for receiving one of said lateral edges of said curtain.

11. A combination garage door and roll-up curtain system according to claim 10, further comprising a master control system operably connected to a power source, said garage door assembly, and said curtain assembly, wherein said master control system is operable to activate said garage door assembly to lower and raise said garage door and to activate said curtain assembly to lower and raise said curtain.

12. A combination garage door and roll-up curtain system according to claim 11, wherein said master control system is further operable to prevent said curtain from being lowered when said garage door is lowered and to prevent said garage door from being lowered when said curtain is lowered.

13. A combination garage door and roll-up curtain system according to claim 12, further comprising a fabric stiffener attached to each of said lateral edges of said curtain to prevent said lateral edges from being dislodged from said linear tracks.

14. A combination garage door and roll-up curtain system for covering and uncovering an opening through a wall, said opening defined by upper, lower, and opposing lateral margins, said system comprising:

a structural support bracket mounted to an inside surface of said wall, said bracket including a substantially horizontal portion mounted directly to said inside surface above said upper margin of said opening and extending away from said wall, a substantially vertical portion extending downward from said horizontal portion thereby providing an open space between said vertical portion and said wall, and an extension member extending horizontally from said vertical portion towards said wall;

a garage door assembly including a pair of tracks having vertical portions mounted in close proximity to said lateral margins of said opening, a garage door having a plurality of lateral rollers secured within said tracks, a drive mechanism secured to and supported by said bracket, and a torsion spring operating said garage door and being positioned within the space formed between said vertical portion of said bracket and said inside surface of said wall, wherein said drive mechanism is operably connected to said garage door for raising and lowering said garage door; and a roll-up curtain assembly including a pair of linear tracks mounted to said inside surface of said wall adjacent said lateral margins of said opening, a rotatable rod mounted above said upper margin of said opening within the space formed between said vertical portion of said bracket and said inside surface of said wall, and a flexible curtain having an upper first end affixed to said rod and a lower second end secured along its lateral edges within said linear tracks;

wherein said rotatable rod is positioned above said torsion spring, and wherein said extension member attaches to and supports a central portion of said torsion spring thereby providing a space between said torsion spring and said wall to allow said flexible curtain to pass between said torsion spring and said wall.

15. A combination garage door and roll-up curtain system according to claim 14, further comprising a master control system operably connected to a power source, said garage door assembly, and said curtain assembly, wherein said master control system is operable to activate said garage door assembly to lower and raise said garage door and to activate said curtain assembly to lower and raise said curtain.

16. A combination garage door and roll-up curtain system according to claim 15, wherein said master control system is further operable to prevent said curtain from being lowered when said garage door is lowered and to prevent said garage door from being lowered when said curtain is lowered.

17. A combination garage door and roll-up curtain system according to claim 14, further comprising a weighted member attached to said second end of said curtain to urge said second end toward said lower margin of said opening.

18. A combination garage door and roll-up curtain system according to claim 14, further comprising a fabric stiffener attached to each of said lateral edges of said curtain to prevent said lateral edges from being dislodged from said linear tracks.

19. A combination garage door and roll-up curtain system according to claim 14, wherein each linear track comprises a planar back portion that abuts said wall, an internal flange connected to a first side of said back portion and having a planar portion in spaced relationship to said back portion, and an external flange connected to a second side of said back portion and overlapping said planar portion of said internal flange, wherein said external flange has a planar portion in spaced relationship to said back portion and said planar portion of said internal flange, thereby forming a longitudinal channel for receiving one of said lateral edges of said curtain.

* * * * *